US010366655B1

(12) United States Patent
Chen

(10) Patent No.: US 10,366,655 B1
(45) Date of Patent: Jul. 30, 2019

(54) PIXEL DRIVER CIRCUIT AND DRIVING METHOD THEREOF

(71) Applicant: Shenzhen China Star Optoelectronics Semiconductor Display Technology Co., Ltd., Shenzhen (CN)

(72) Inventor: Xiaolong Chen, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 118 days.

(21) Appl. No.: 15/580,280

(22) PCT Filed: Nov. 16, 2017

(86) PCT No.: PCT/CN2017/111374
§ 371 (c)(1),
(2) Date: Dec. 7, 2017

(87) PCT Pub. No.: WO2019/037301
PCT Pub. Date: Feb. 28, 2019

(30) Foreign Application Priority Data

Aug. 23, 2017 (CN) ..... 2017 1 0731420

(51) Int. Cl.
*G09G 3/3258* (2016.01)
*G09G 3/3291* (2016.01)
*G09G 3/3266* (2016.01)

(52) U.S. Cl.
CPC ..... *G09G 3/3258* (2013.01); *G09G 3/3266* (2013.01); *G09G 3/3291* (2013.01); *G09G 2330/00* (2013.01)

(58) Field of Classification Search
CPC .. G09G 3/3258; G09G 3/3266; G09G 3/3291; G09G 2330/00
See application file for complete search history.

(56) References Cited

U.S. PATENT DOCUMENTS

2014/0313106 A1* 10/2014 In ..... G09G 3/3233 345/76
2017/0329189 A1* 11/2017 Kim ..... G02F 1/13454

FOREIGN PATENT DOCUMENTS

CN 102945654 A 2/2013
CN 103680406 A 3/2014
(Continued)

*Primary Examiner* — Robert J Michaud
(74) *Attorney, Agent, or Firm* — Leong C. Lei

(57) ABSTRACT

The invention discloses a pixel driver circuit and driving method thereof. The pixel driver circuit comprises a first TFT (T1), connected to first node (g), second node (s) and third node (p); a second TFT (T2), connected to scan signal (Scan1), fourth node (n) and voltage input end (Vdata/Vref1); a third TFT (T3), connected to scan signal (Scan1), first node (g) and second reference voltage (Vref2); a fourth TFT (T4), connected to first control signal (EM1), third node (p) and high voltage power source (OVDD); a fifth TFT (T5), connected to second control signal (EM2), second node (s) and anode of OLED; the OLED, having a cathode connected to low voltage power source (OVSS); a first capacitor C1 and a second capacitor C2. The invention also provides corresponding driving method. The pixel driver circuit and driving method of the present invention can eliminate the impact of the threshold voltage Vth on the LED, improve display evenness of the panel and improve the light-emission efficiency.

13 Claims, 5 Drawing Sheets

(56) References Cited

FOREIGN PATENT DOCUMENTS

| | | | |
|---|---|---|---|
| CN | 104036724 | A | 9/2014 |
| CN | 104200779 | A | 12/2014 |
| CN | 104409042 | A | 3/2015 |
| CN | 107025883 | A | 8/2017 |
| CN | 107301E345 | A | 10/2017 |

* cited by examiner

PIXEL DRIVER CIRCUIT AND DRIVING METHOD THEREOF

BACKGROUND OF THE INVENTION

1. Field of the Invention

The present invention relates to the field of display techniques, and in particular to a pixel driver circuit and driving method thereof.

2. The Related Arts

As a new-generation display technology, the organic light emitting diode (OLED) display provides the advantages of low power consumption, high color gamut, high resolution, wide viewing angle, quick response time, and so on, and attracts much market attention.

The driving types of OLED can be divided, according to the driving method, into the passive matrix OLED (PMOLED) and active matrix OLED (AMOLED); wherein the AMOLED provides the advantages of pixels arranged in an array, self-luminous, and high luminous efficiency and is commonly used for high definition large-size display. AMOLED is a current-driven device and the light-emitting luminance is determined by the current flowing through the OLED. Most of the known integrated circuits (ICs) only transmit voltage signals, so the AMOLED pixel driver circuit needs to complete the task of converting the voltage signal into a current signal.

As shown in FIG. 1, a known 2T1C pixel driver circuit for OLED is shown. The 2T1C refers to the driver circuit comprising two thin film transistors (TFTs) and a capacitor, wherein one TFT T2 is a switching TFT, controlled by a scan signal Gate, for controlling the entry of data signal Data, serving as a switch for charging the capacitor Cst, and the other TFT T1 is a driving TFT, for driving the OLED and controlling the current flowing through the OLED; the capacitor Cst is for storing the Data signal so as to control the driving current of the T1 on the OLED. The scan signal Gate is from a gate driver, corresponding to a certain scan line, the data signal Data is from a source driver, corresponding to a certain data line. OVDD is a high voltage of the power source, and OVSS is the low voltage of the power source. According to transistor I-V (current-voltage) equation:

$$I_{ds,sat}=k\cdot(V_{GS}-V_{th,T1})^2=k\cdot(V_G-V_S-V_{th,T1})^2 \quad (1)$$

Wherein K is an intrinsic conductivity factor, saturated current $I_{ds,sat}$ has a value related to driving TFT (T1) threshold voltage.

The threshold voltage Vth of the driving TFT of each sub-pixel in the panel is different due to the instability of the panel manufacturing process. Therefore, even if a same data voltage (Vdata) is applied to the driving TFT of each pixel, the current flowing into the OLED may still be different, resulting in inconsistent image quality displaying.

Moreover, as the time passes, the TFT material of the driving TFT ages and changes, and the threshold voltage Vth of the driving TFT is drifted. The different degree of aging of the TFT material in each driving TFT will cause different amount of drift of the threshold voltage Vth in each driving TFT of the panel, resulting in the unevenness of the panel display. The aging of the TFT material becomes more serious as more time passes. The luminous current flowing through the OLED is likely to be different even with the same driving voltage, resulting in uneven brightness. In addition, the ageing of OLED element will also cause problems, such as, the OLED activation voltage increasing, the current flowing into the OLED gradually reduced, resulting in a decrease in the luminance of the panel and a decrease in the luminous efficiency.

The saturated current $I_{ds,sat}$ of the known 2T1C driver circuit for the OLED shown in FIG. 1 has a value related to driving TFT (T1) threshold voltage, and the driver circuit will cause the uneven display in panels and be affected by the ageing of the OLED. Therefore, the known technology provides the 5T2C driver circuit for OLED shown in FIG. 2, with FIG. 3 showing the timing sequence. The 5T2C driver circuit comprises TFT MD, M1-M4, capacitors C1 and C2, and the control signals Scan1, Scan2, Em, and data.

Although the 5T2C architecture shown in FIG. 2 can eliminate the drifting of the threshold voltage Vth of the driving TFT, the voltage level of the node A is kept Vdata+OVDD−Vth−Vref during the data-writing and light-emitting phases. Since the OLED unevenness of the panel causes inconsistency of the $V_{OLED}$ of each sub-pixel, the over-large reference voltage Vref causes the OLED to emit light in reset phase, while the over-small reference voltage Vref causes the over-large node A voltage in the data-writing and light-emitting phases, leading to the driving TFT staying in the cut-off state. Therefore, the value of Vref is difficult to grasp.

To eliminate the threshold voltage Vth drifting of the driving TFT, the prior art also provides a 6T2C pixel driver circuit. Referring to FIG. 4, FIG. 4 is a 6T2C pixel driver circuit and a timing sequence for a conventional OLED. Although the 6T2C architecture can eliminate the Vth drifting of the driving TFT, the number of TFTs used (6) will cause the design of the pixel layout complicated, the decrease of the aperture rate, and the need for more timing control signals (5), Scan1, Scan2, Scan3, EM1, and EM2, causing the timing controller (TCON) to become complicated.

SUMMARY OF THE INVENTION

The object of the present invention is to provide a pixel driver circuit, able to eliminate the impact of the threshold voltage Vth of the driving TFT of the OLED driver circuit on the OLED.

Another object of the present invention is to provide a driving method of pixel driver circuit, able to eliminate the impact of the threshold voltage Vth of the driving TFT of the OLED driver circuit on the OLED.

To achieve the above object, the present invention provides a pixel driver circuit, which comprises:

a first thin film transistor (TFT), having a gate connected to a first node, a source and a drain connected respectively to a second node and a third node;

a second TFT, having a gate connected to a scan signal, a source and a drain connected respectively to a fourth node and a voltage input end;

a third TFT, having a gate connected to the scan signal, a source and a drain connected respectively to the first node and a second reference voltage;

a fourth TFT, having a gate connected to a first control signal, a source and a drain connected respectively to the third node and a high voltage power source;

a fifth TFT, having a gate connected to a second control signal, a source and a drain connected respectively to the second node and an anode of an OLED;

the OLED, having a cathode connected to a low voltage power source;

a first capacitor, having two ends connected respectively to the first node and the second node; and a second capacitor, having two ends connected respectively to the second node and the fourth node.

According to a preferred embodiment of the present invention, the scan signal, the first control signal, and the second control signal have timing sequence configured for a data voltage writing-in and threshold voltage storage phase, an electric charge phase, and a light-emitting phase.

According to a preferred embodiment of the present invention, in the data voltage writing-in and threshold voltage storage phase, the voltage input end inputs a data voltage.

According to a preferred embodiment of the present invention, in the charge-sharing phase, the voltage input end inputs a first reference voltage.

According to a preferred embodiment of the present invention, in the data voltage writing-in and threshold voltage storage phase, the scan signal is at high voltage, the first control signal is at high voltage, and the second control voltages is at low voltage.

According to a preferred embodiment of the present invention, in the charge-sharing phase, the scan signal is at high voltage, the first control signal is at low voltage, and the second control voltages is at low voltage.

According to a preferred embodiment of the present invention, in the light-emitting phase, the scan signal is at low voltage, the first control signal is at high voltage, and the second control voltages is at high voltage.

The present invention also provides a driving method of the aforementioned pixel driver circuit, which comprises: the scan signal, the first control signal, and the second control signal have timing sequence configured for a data voltage writing-in and threshold voltage storage phase, an electric charge phase, and a light-emitting phase.

According to a preferred embodiment of the present invention, in the data voltage writing-in and threshold voltage storage phase, the voltage input end inputs a data voltage.

According to a preferred embodiment of the present invention, in the charge-sharing phase, the voltage input end inputs a first reference voltage.

The present invention also provides a pixel driver circuit, which comprises:

a first thin film transistor (TFT), having a gate connected to a first node, a source and a drain connected respectively to a second node and a third node;

a second TFT, having a gate connected to a scan signal, a source and a drain connected respectively to a fourth node and a voltage input end;

a third TFT, having a gate connected to the scan signal, a source and a drain connected respectively to the first node and a second reference voltage;

a fourth TFT, having a gate connected to a first control signal, a source and a drain connected respectively to the third node and a high voltage power source;

a fifth TFT, having a gate connected to a second control signal, a source and a drain connected respectively to the second node and an anode of an OLED;

the OLED, having a cathode connected to a low voltage power source;

a first capacitor, having two ends connected respectively to the first node and the second node; and a second capacitor, having two ends connected respectively to the second node and the fourth node;

wherein the scan signal, the first control signal, and the second control signal having timing sequence being configured for a data voltage writing-in and threshold voltage storage phase, an electric charge phase, and a light-emitting phase;

wherein, in the data voltage writing-in and threshold voltage storage phase, the voltage input end inputting a data voltage.

wherein, in the charge-sharing phase, the voltage input end inputting a first reference voltage.

wherein, in the data voltage writing-in and threshold voltage storage phase, the scan signal being at high voltage, the first control signal being at high voltage, and the second control voltages being at low voltage.

In summary, the pixel driver circuit and driving method of the present invention eliminates the impact of the threshold voltage Vth of the driving TFT of the OLED driver circuit on the OLED, can improve the display evenness of the panel and light emission efficiency.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 1:
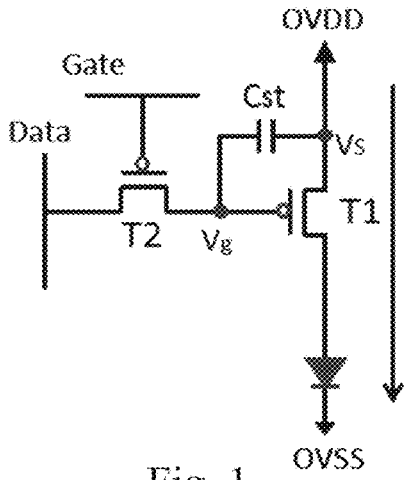
FIG. 1 is a schematic view showing a known 2T1C pixel driver circuit.
Figure 2:
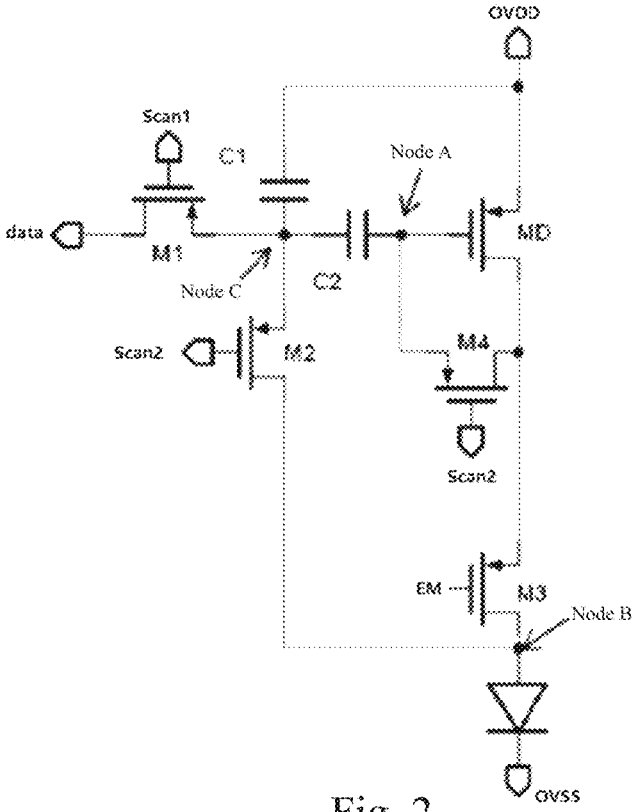
FIG. 2 is a schematic view showing a known 5T2C pixel driver circuit.
Figure 3:
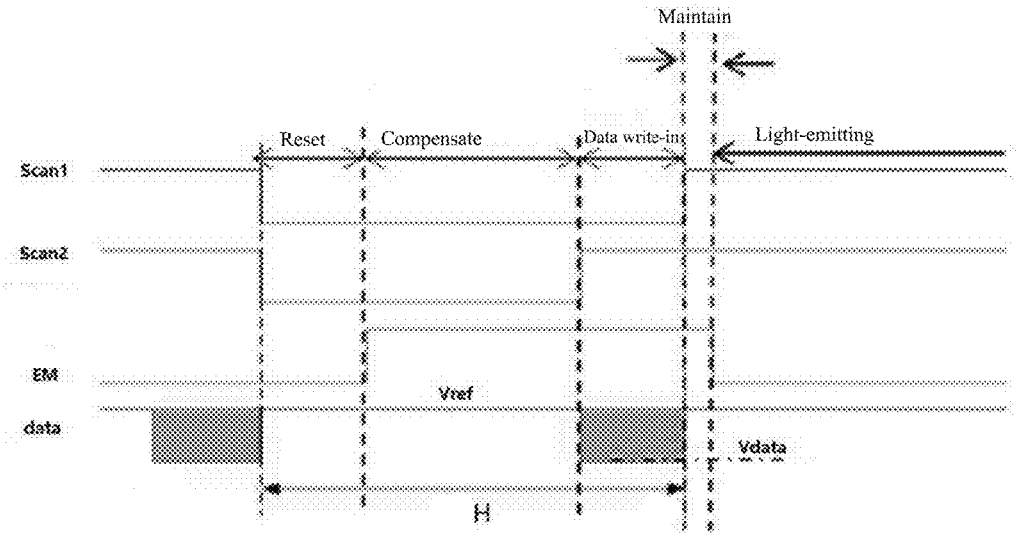
FIG. 3 is a schematic view showing the timing sequence of FIG. 2.
Figure 4:
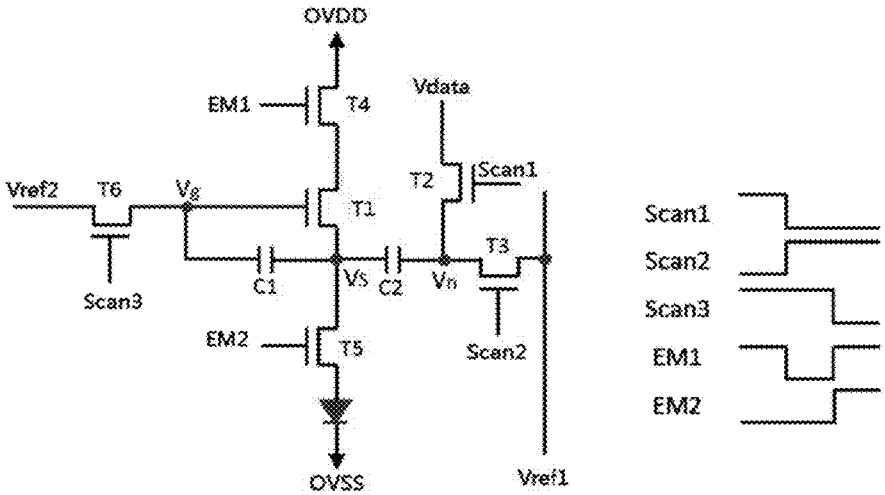
FIG. 4 is a schematic view showing a known 6T2C OLED pixel driver circuit.
Figure 5:
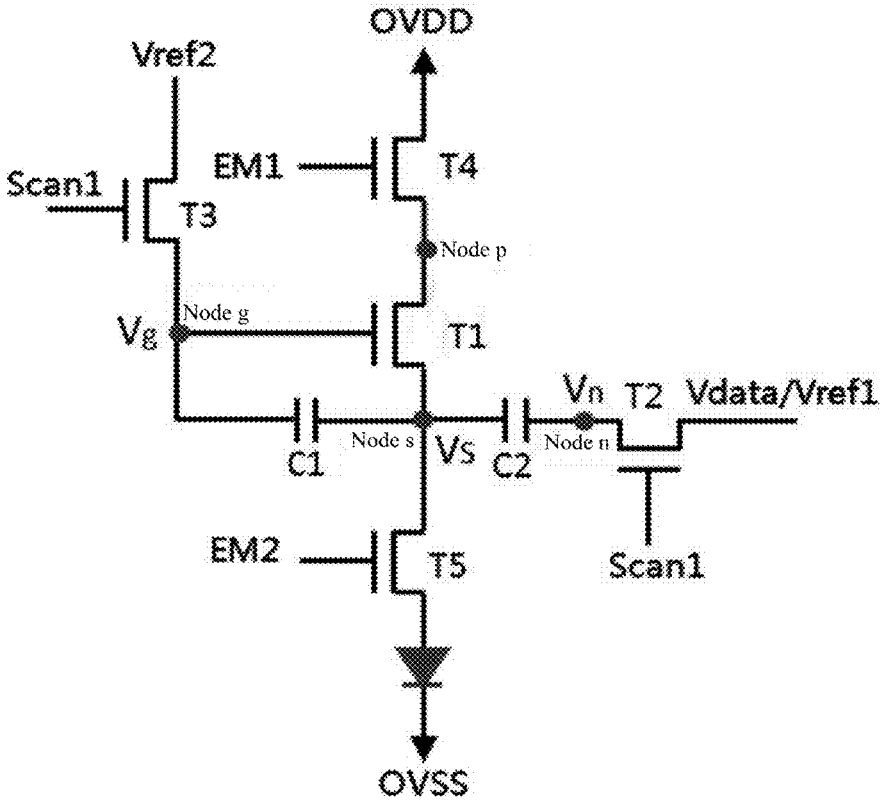
FIG. 5 is a schematic view showing the circuit of a preferred embodiment of the pixel driver circuit of the present invention.

Referring to FIG. 5, FIG. 5 is a schematic view showing the circuit of a preferred embodiment of the pixel driver circuit of the present invention. The present invention provides a 5T2C OLED element driver circuit for driving an OLED, using fewer TFTs (5 TFTs) and fewer timing control lines (3 control lines). The compensation process mainly includes three phases, namely, a data voltage write-in and threshold voltage Vth storage phase, a charge-sharing phase, and a (LED) light-emitting phase. The compensation circuit will not introduce $V_{OLED}$, the current will not be reduced when the OLED degraded due to ageing, and the compensation circuit eliminates the impact of the threshold voltage Vth on the LED to improve display evenness. The compensated current is independent of OVDD/OVSS, and is not affected by the IR drop.

The preferred embodiment comprises: a TFT T1, having a gate connected to a first node g, a source and a drain connected respectively to a node s and a node p; a TFT T2, having a gate connected to a scan signal Scan1, a source and a drain connected respectively to a node n and a voltage input end Vdata/Vref1; a TFT T3, having a gate connected to the scan signal Scan1, a source and a drain connected respectively to the node g and a reference voltage Vref1; a TFT T4, having a gate connected to a control signal Em1, a source and a drain connected respectively to the node p and a high voltage power source OVDD; a TFT T5, having a gate connected to a control signal EM2, a source and a drain connected respectively to the node s and an anode of an OLED; the OLED, having a cathode connected to a low voltage power source OVSS; a capacitor C1, having two ends connected respectively to the node g and the node s; and a capacitor C2, having two ends connected respectively to the node s and the node n.

Figure 6:
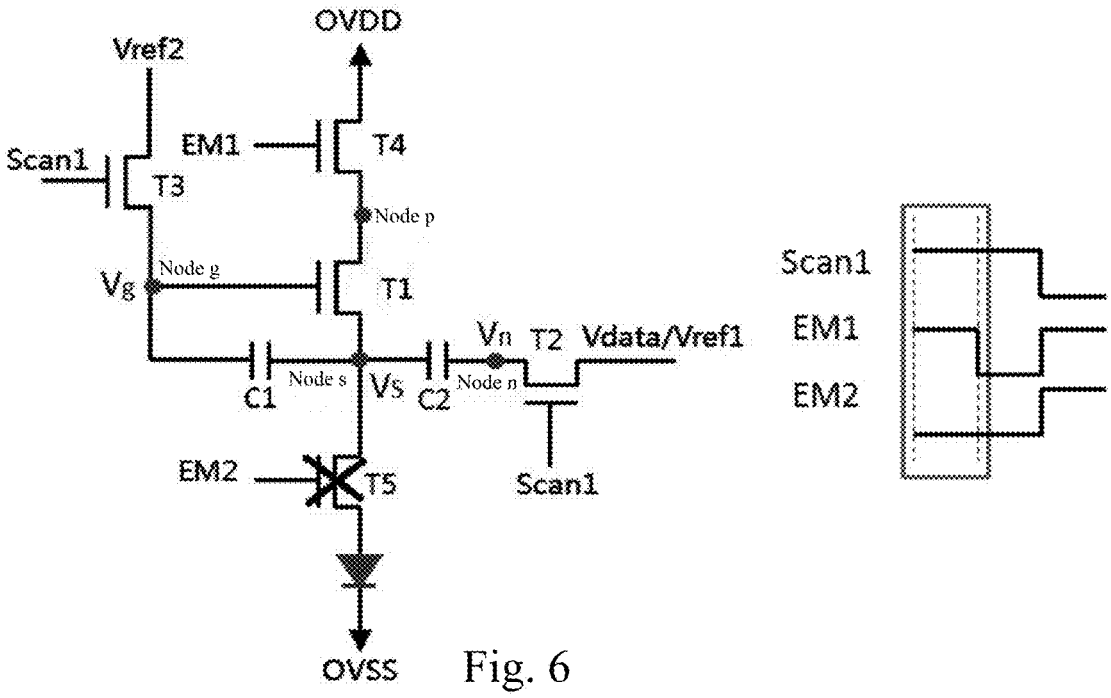
FIG. 6 is a schematic view showing the circuit state and timing sequence in the data voltage write-in and threshold voltage storage phase of a preferred embodiment of the pixel driver circuit of the present invention.

Refer to FIG. 6. FIG. 6 is a schematic view showing the circuit state and corresponding timing sequence in the data voltage write-in and threshold voltage Vth storage phase of the pixel driver circuit. In the data voltage write-in and threshold voltage Vth storage phase, Scan1 and EM1 are at high voltage, EM2 is at low voltage, and T5 is cut-off.

T2 is turned on. At this point, the data voltage Vdata charges node n to Vn=Vdata. T3 is turned on, the reference voltage Vref2 changes node g to Vg=Vref2. T4 is turned on, OVDD charges node s until the voltage difference between node g and node s is Vth. At this point, Vg−Vs=Vth, and the charges of Vth is stored in the capacitor C1. Vs=Vg−Vth=Vref2−Vth. And T5 is cut-off to ensure that the OLED does not emit light in this phase.

Figure 7:
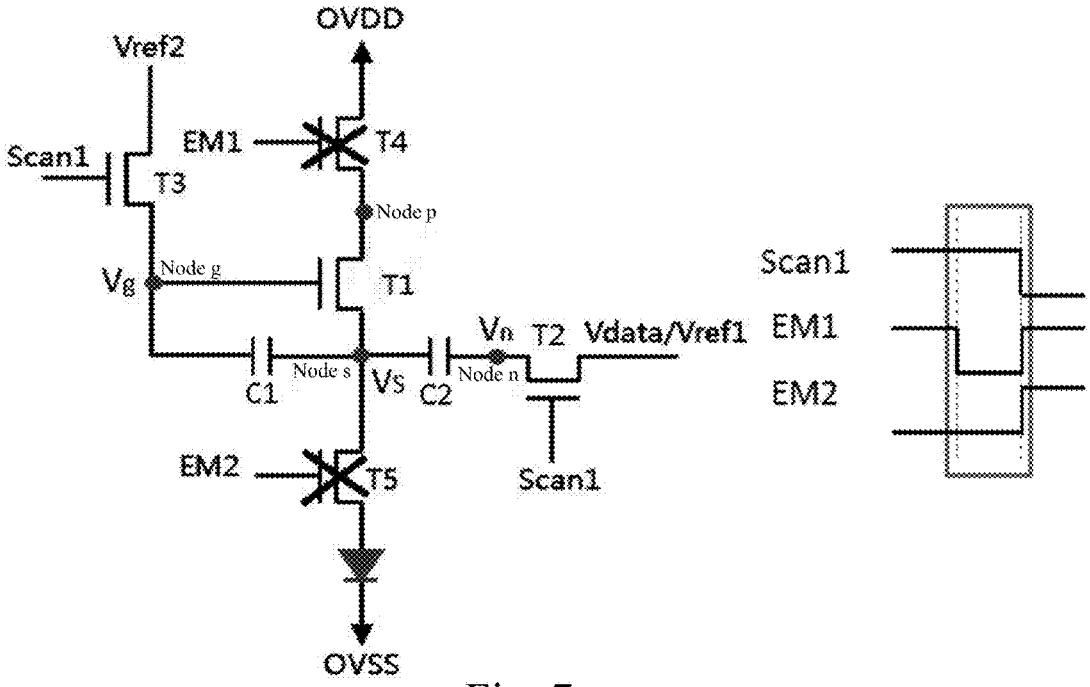
FIG. 7 is a schematic view showing the circuit state and timing sequence in the charge-sharing phase of a preferred embodiment of the pixel driver circuit of the present invention.

Refer to FIG. 7. FIG. 7 is a schematic view showing the circuit state and corresponding timing sequence in the charge-sharing phase of the pixel driver circuit. In the charge-sharing phase, Scan1 is at high voltage, and EM1 and EM2 are at low voltage.

T3 is turned on, node g stays at Vg=Vref2; T2 is turned on, and the reference voltage Vref1 charges node n, and the voltage at node n changes from Vdata to Vn=Vref1; T4 and T5 are cut-off, according to charge-sharing principle, the voltage at node s changes from Vref2−Vth to Vs=Vref2−Vth+δV, where δV=(vref1−Vdata)×C2/(C1+C2); the voltage difference Vgs between node g and node s becomes Vref2−(Vref2−Vth+δV)=Vth−δV. And T5 is cut-off to ensure that the OLED does not emit light in this phase.

Figure 8:
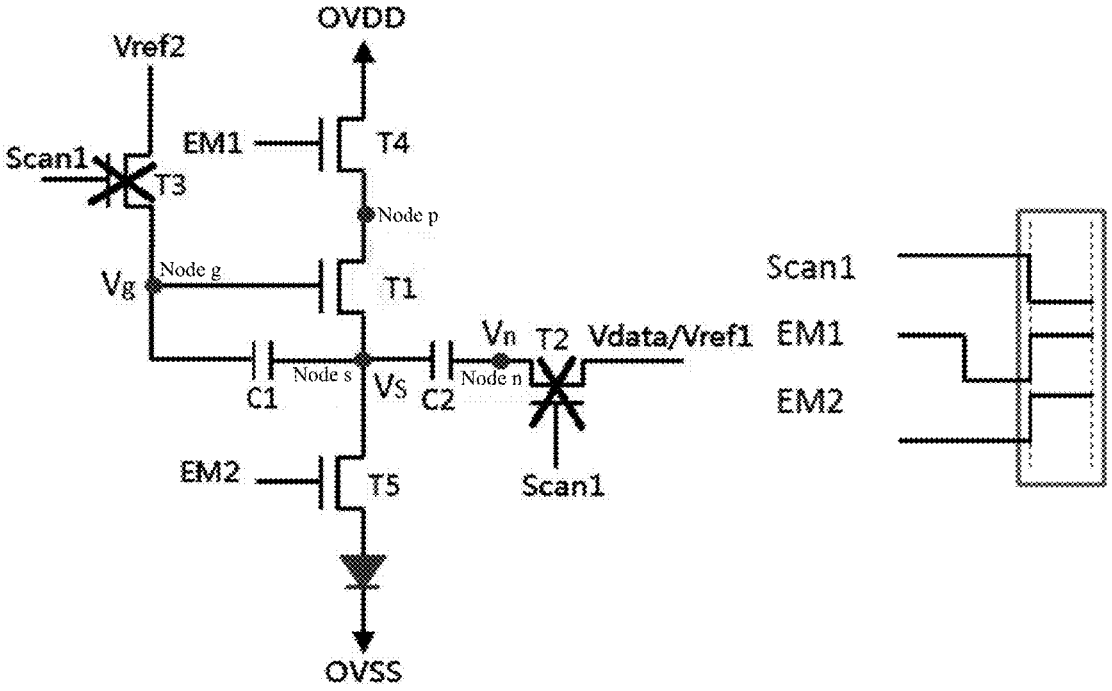
FIG. 8 is a schematic view showing the circuit state and timing sequence in the light-emitting phase of a preferred embodiment of the pixel driver circuit of the present invention.

Refer to FIG. 8. FIG. 8 is a schematic view showing the circuit state and corresponding timing sequence in the light-emitting phase of the pixel driver circuit. In the light-emitting phase, EM1 and EM2 are at high voltage, while Scan1 is at low voltage.

T3 is cut-off, the voltage difference between node g and node s stays the same as in the previous phase; T4 and T5 are cut-off, according to the transistor I-V equation, $I=k(Vgs-Vth)^2=k(Vth-\delta V-Vth)^2=k(-\delta V)^2=k[(Vdata-Vref1)\times C2/(C1+C2)]^2$. Therefore, the current is independent of the driving TFT (T1) threshold voltage Vth, which eliminates the impact of the threshold voltage Vth on the LED, improves display evenness of the panel and improves the light-emission efficiency.

The present invention also provides a driving method of the pixel driver circuit to eliminate the impact of the threshold voltage Vth of the driving TFT in the OLED driving circuit on the OLED, the display evenness of the panel is improved so that the problems of reduced panel luminance caused by ageing, lowered light emission efficiency will not occur. The compensation circuit will not introduce $V_{OLED}$, the current will not be reduced when the OLED degraded due to ageing, and the compensation circuit eliminates the impact of the threshold voltage Vth on the LED to improve display evenness. The compensated current is independent of OVDD/OVSS, and is not affected by the IR drop.

In summary, the pixel driver circuit and driving method of the present invention can eliminate the impact of the threshold voltage Vth on the LED, improve display evenness of the panel and improve the light-emission efficiency.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A pixel driver circuit, which comprises:

a first thin film transistor (TFT), having a gate connected to a first node, a source and a drain connected respectively to a second node and a third node;

a second TFT, having a gate connected to a scan signal, a source and a drain connected respectively to a fourth node and a voltage input end;

a third TFT, having a gate connected to the scan signal, a source and a drain connected respectively to the first node and a second reference voltage;

a fourth TFT, having a gate connected to a first control signal, a source and a drain connected respectively to the third node and a high voltage power source;

a fifth TFT, having a gate connected to a second control signal, a source and a drain connected respectively to the second node and an anode of an OLED;

the OLED, having a cathode connected to a low voltage power source;

a first capacitor, having two ends connected respectively to the first node and the second node; and a second capacitor, having two ends connected respectively to the second node and the fourth node.

2. The pixel driver circuit as claimed in claim 1, wherein the scan signal, the first control signal, and the second control signal have timing sequence configured for a data voltage writing-in and threshold voltage storage phase, an electric charge phase, and a light-emitting phase.

3. The pixel driver circuit as claimed in claim 2, wherein in the data voltage writing-in and threshold voltage storage phase, the voltage input end inputs a data voltage.

4. The pixel driver circuit as claimed in claim 2, wherein in the charge-sharing phase, the voltage input end inputs a first reference voltage.

5. The pixel driver circuit as claimed in claim 2, wherein in the data voltage writing-in and threshold voltage storage phase, the scan signal is at high voltage, the first control signal is at high voltage, and the second control voltages is at low voltage.

6. The pixel driver circuit as claimed in claim 2, wherein in the charge-sharing phase, the scan signal is at high voltage, the first control signal is at low voltage, and the second control voltages is at low voltage.

7. The pixel driver circuit as claimed in claim 2, wherein in the light-emitting phase, the scan signal is at low voltage, the first control signal is at high voltage, and the second control voltages is at high voltage.

8. A driving method of the pixel driver circuit as claimed in claim 1, comprising: the scan signal, the first control signal, and the second control signal having timing sequence configured for a data voltage writing-in and threshold voltage storage phase, an electric charge phase, and a light-emitting phase.

9. The driving method of pixel driver circuit as claimed in claim 8, wherein in the data voltage writing-in and threshold voltage storage phase, the voltage input end inputs a data voltage.

10. The driving method of pixel driver circuit as claimed in claim 8, wherein in the charge-sharing phase, the voltage input end inputs a first reference voltage.

11. A pixel driver circuit, which comprises:

a first thin film transistor (TFT), having a gate connected to a first node, a source and a drain connected respectively to a second node and a third node;

a second TFT, having a gate connected to a scan signal, a source and a drain connected respectively to a fourth node and a voltage input end;

a third TFT, having a gate connected to the scan signal, a source and a drain connected respectively to the first node and a second reference voltage;

a fourth TFT, having a gate connected to a first control signal, a source and a drain connected respectively to the third node and a high voltage power source;

a fifth TFT, having a gate connected to a second control signal, a source and a drain connected respectively to the second node and an anode of an OLED;

the OLED, having a cathode connected to a low voltage power source;

a first capacitor, having two ends connected respectively to the first node and the second node; and a second capacitor, having two ends connected respectively to the second node and the fourth node;

wherein the scan signal, the first control signal, and the second control signal having timing sequence being configured for a data voltage writing-in and threshold voltage storage phase, an electric charge phase, and a light-emitting phase;

wherein in the data voltage writing-in and threshold voltage storage phase, the voltage input end inputting a data voltage;

wherein in the charge-sharing phase, the voltage input end inputting a first reference voltage;

wherein in the data voltage writing-in and threshold voltage storage phase, the scan signal being at high voltage, the first control signal being at high voltage, and the second control voltages being at low voltage.

12. The pixel driver circuit as claimed in claim 11, wherein in the charge-sharing phase, the scan signal is at high voltage, the first control signal is at low voltage, and the second control voltages is at low voltage.

13. The pixel driver circuit as claimed in claim 11, wherein in the light-emitting phase, the scan signal is at low voltage, the first control signal is at high voltage, and the second control voltages is at high voltage.

* * * * *